US005329899A

United States Patent [19]

Sawert et al.

[11] Patent Number: 5,329,899

[45] Date of Patent: Jul. 19, 1994

[54] FUEL SYSTEM PRESSURE FUSE

[75] Inventors: Ulf Sawert, Grand Blanc; Timothy F. Coha, Davison; William S. Zimmerman; Gregory K. Rasmussen, both of Grand Blanc, all of Mich.

[73] Assignee: General Motors Corporation, Detroit, Mich.

[21] Appl. No.: 134,439

[22] Filed: Oct. 12, 1993

[51] Int. Cl.[5] ..... F02B 77/00; F02M 37/04

[52] U.S. Cl. ..... 123/198 DB; 123/514; 123/468; 138/121

[58] Field of Search ..... 123/198 D, 198 DB, 468, 123/514, 457, 469, 470, 456, 509, 510, 467, 447; 137/67, 572, 574, 576, 590, 460, 461; 138/28, 30, 100, 121

[56] References Cited

U.S. PATENT DOCUMENTS

| | | | |
|---|---|---|---|
| 4,191,358 | 3/1980 | Ferri | 138/121 |
| 4,510,968 | 4/1985 | Rau | 137/590 |
| 4,649,884 | 3/1987 | Tuckey | 123/470 |
| 4,660,524 | 4/1987 | Bertsch | 123/468 |
| 4,793,384 | 12/1988 | Lalikos | 138/121 |
| 4,893,647 | 1/1990 | Tuckey | 137/576 |
| 4,945,884 | 8/1990 | Coha et al. | 123/509 |
| 4,972,875 | 11/1990 | Beer et al. | 137/590 |
| 4,974,570 | 12/1990 | Szwargolski | 137/572 |
| 5,038,741 | 8/1991 | Tuckey | 137/576 |
| 5,052,437 | 1/1991 | Danka | 137/590 |
| 5,070,849 | 12/1991 | Rich | 137/576 |
| 5,080,077 | 1/1992 | Sawert et al. | 123/514 |
| 5,129,429 | 7/1992 | Winter | 138/121 |

*Primary Examiner*—Carl S. Miller
*Attorney, Agent, or Firm*—Karl F. Barr, Jr.

[57] ABSTRACT

A high pressure fuel hose for disposition between a fluid connector on a fuel pump canister in a fuel reservoir and a fluid connector through the reservoir wall. The fuel hose, located intermediate the fuel delivery system and a check valve at the fuel pump, has a flexible tubular body characterized by a plurality of annular sinusoidal convolutions well suited for accepting volumetric and pressure increases in the fuel trapped between the check valve and the fuel delivery system caused by temperature loading of the fuel following engine shut-down. A region of reduced wall thickness is formed in the tubular body to act as a pressure fuse having a predetermined burst pressure allowing system leakage due to overpressurization to be location controlled.

4 Claims, 2 Drawing Sheets

FUEL SYSTEM PRESSURE FUSE

TECHNICAL FIELD

The invention relates to a fuel delivery system for an internal combustion engine and, more particularly, to a fuel system pressure fuse operable within the fuel tank of the fuel system.

BACKGROUND OF THE INVENTION

Manufacturing economies are realized by grouping several related components into a modular assembly which may be handled, installed and serviced as a unit. In automotive fuel systems for example, modular fuel delivery systems have been proposed for direct installation in a fuel tank. Such systems are typically installed through an opening in the top of the fuel tank and may include an electric fuel pump, a cover for the tank opening, elements for supporting the pump relative to the cover and means for electrically and fluidly connecting the pump to the electrical and fuel delivery systems of the internal combustion engine. A flexible, high pressure hose constructed of rubber or flexible plastic may be provided as a conduit between the pump outlet and the cover, with a check valve disposed downstream of the pump and operable to maintain fuel system pressure following engine and fuel system shut-down. A high pressure hose according to the present invention includes structural features which manage positive fuel pressure variation of fuel between the check valve and the fuel injectors of the fuel delivery system.

SUMMARY OF THE INVENTION

The present invention is directed to a fuel delivery system pressure fuse for use between a fuel pump check valve and the fuel delivery system of an internal combustion engine. The pressure fuse, according to the invention, is preferably constructed of a fuel resistant, blow-moldable elastomer such as commonly available NYLON 11 and includes a flexible tubular body, characterized by a plurality of annular sinusoidal convolutions, the ends of which fluidly connect the outlet of a fuel tank mounted fuel pump to a fluid connector disposed through the wall of the tank. A fuel conduit, external to the fuel tank, conducts fuel delivered to the fluid connector in the tank wall to the fuel delivery components of the engine. As an aid to engine start a fuel system check valve is disposed at the interface of the fuel pump and the pressure fuse to maintain fuel within the fuel conduit following shut-down of the engine and fuel system. With the advent of non-return demand fuel systems for the reduction of running loss hydrocarbon emissions, fuel held between the check valve and the fuel injectors may, under certain circumstances be subject to heating, with concomitant pressure and volumetric increases. The flexible tubular body of the fuel system pressure fuse, located in the fuel reservoir between the check valve and the fuel conduit, is operable as a volume accumulator capable of accepting the volume increase of the heated fuel and thereby reducing the stress imposed on the fuel system. Additionally, a region of reduced wall thickness, having a predetermined burst pressure, is formed in the tubular body of the pressure fuse. The burst pressure of the reduced thickness area is engineered such that failure of the fuel system due to overpressurization between the check valve and the fuel delivery components occurs at that location, within the fuel reservoir, where such leakage poses a minimum of concern.

These and other features, objects and advantages of the invention will be more apparent by reference to the following detailed description and to the drawings.

DESCRIPTION OF THE PREFERRED EMBODIMENT

Figure 1:
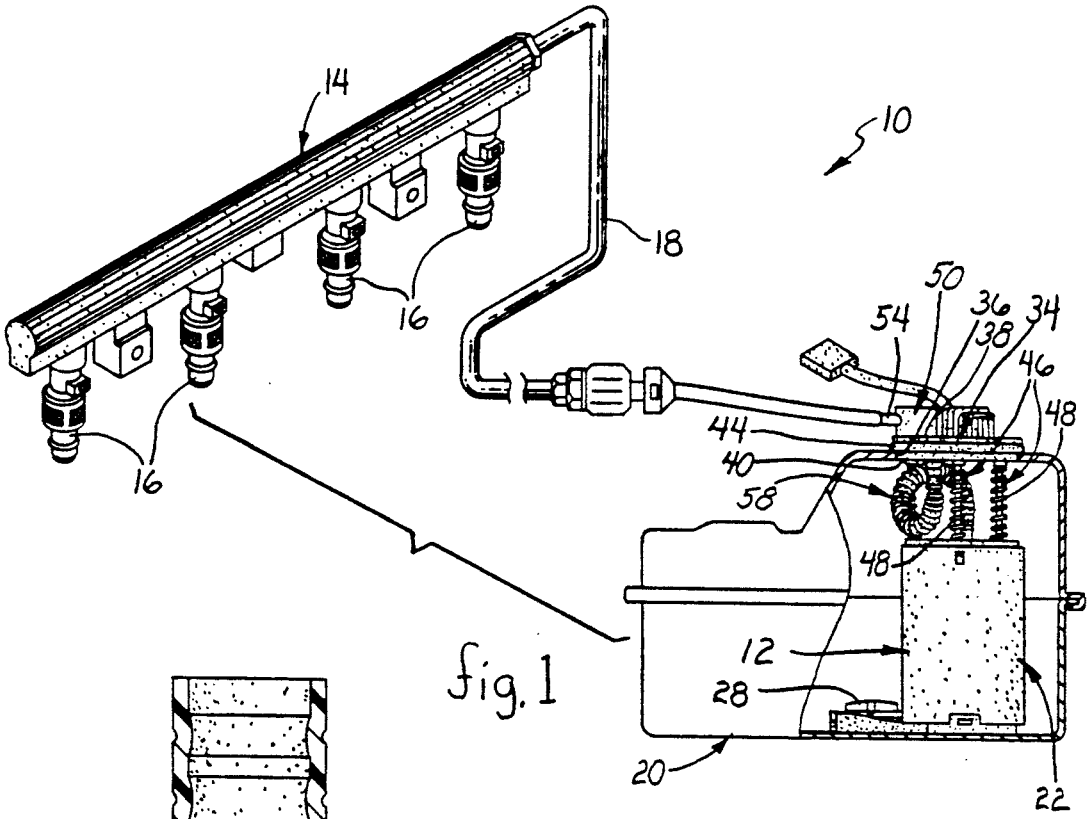
FIG. 1 is a partial, schematic view of an automotive fuel system.

In FIG. 1 there is shown a fuel system, designated generally as 10, for use with an internal combustion engine, not shown. The fuel system 10 comprises a tank mounted, modular fuel pump assembly 12, a fuel delivery system which, in the embodiment illustrated, includes a fuel rail or manifold 14 to which several fuel injectors 16 are operably attached, and a fuel conduit 18 which extends between the fuel reservoir 20 and the fuel rail 14. Depending upon the particular application of the fuel system 10, other features such as fuel filter and fuel vapor recovery canister may also be included as system components.

Figure 2:
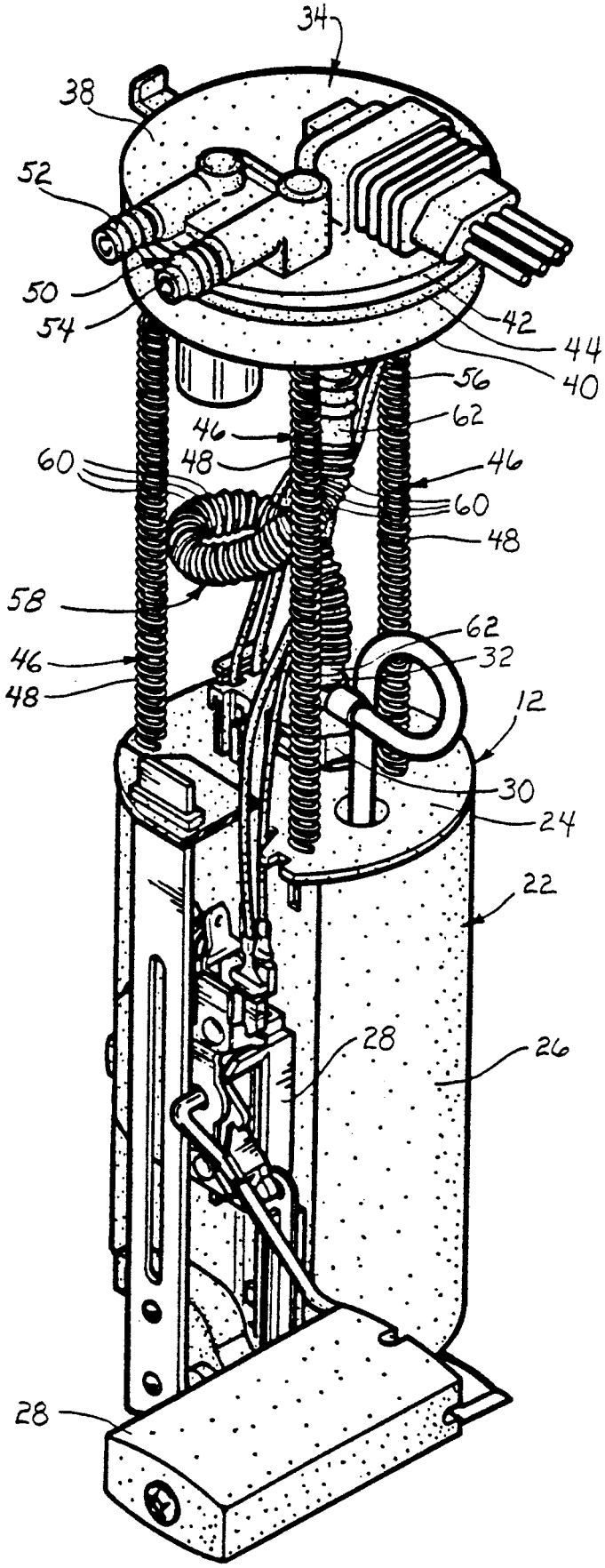
FIG. 2 is a perspective view of a modular fuel delivery system embodying features of the present invention.

FIG. 2 shows the tank mounted, modular fuel pump assembly 12 to include a reservoir canister 22 having a top 24 and cylindrical walls 26. A fuel level transducer assembly 28 is attached to the exterior of the reservoir canister 22. An electric fuel pump (not shown) disposed within canister 22 is operable to withdraw fuel from the reservoir 20, pressurize the fuel to a desired operating pressure and direct the pressurized fuel to the fuel conduit 18 for delivery to the engine. The pressurized fuel is delivered from the pump discharge to an integral fluid connector 32 in a wall of canister 22. A check valve 30 disposed adjacent the fluid connector 32 prevents a backflow of fuel from the fuel rail 14 and the fuel conduit 18 following engine and fuel system shut-down, aiding in subsequent engine start-up.

The assembly 12 further includes a cover 34 for closing a port or opening 36 in the fuel reservoir 20 having an exposed or exterior surface 38 and an inner or interior surface 40 facing canister 22 and an integral depending flange 42 about which extends a resilient sealing member 44 for sealing engagement with a corresponding flange, not shown, extending about reservoir opening 36. The cover 34 is connected to reservoir canister 22 by a plurality of supporting struts 46 having coil springs 48 disposed thereabout to urge relative separation between the cover 34 and the canister 22. A high pressure fluid connector 50 and a vapor connector 52 are integral with the cover 34. On the outer surface 38 a tubular stem 54 is configured to receive the end of fuel conduit 18. To the inside surface of the cover 34, a second tubular stem 56 is similarly operably attached to a high pressure hose 58, according to this invention, which extends between and fluidly connects the integral fluid connector 32 atop reservoir canister 22 with the fluid connector 50 in cover 34 through which pressurized fuel exits the fuel reservoir 20.

Figure 3:
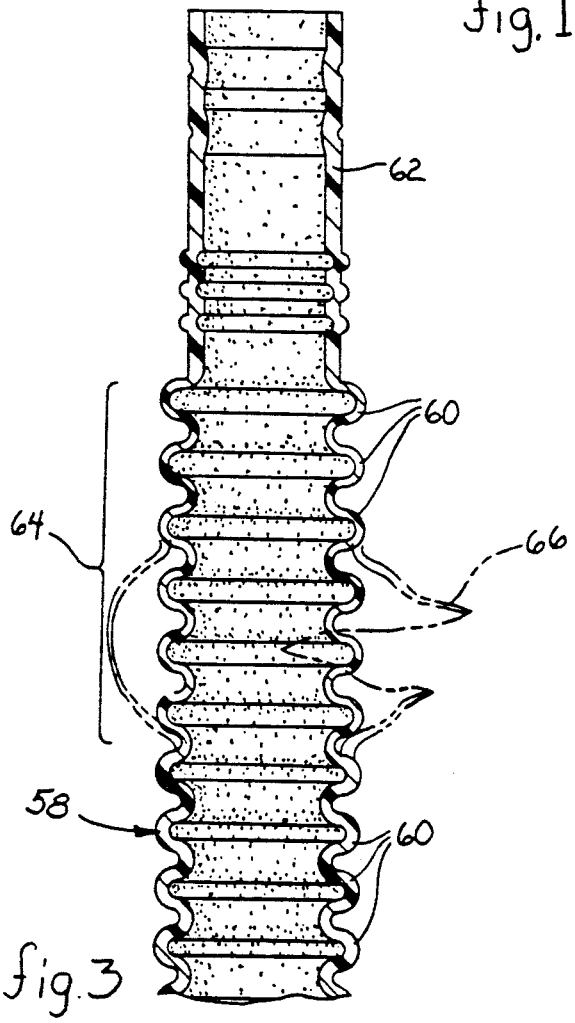
FIG. 3 is a partial, sectional view of a high pressure fuel hose, used in the modular fuel system of FIG. 2.

As shown in FIG. 3, the high pressure hose 58 according to the present invention, includes a tubular body characterized by a plurality of annular, sinusoidal convolutions 60 and a pair of integral, relatively inflexible cylindrical end portions 62. The high pressure hose is preferably blow molded from fuel resistant plastic, preferably a commonly available material such as NYLON 11. The hose 58 is looped between the cover 34 and the reservoir canister 22 to accommodate movement therebetween and the end portions 62 are connected to the connectors 56 and 32 of cover 34 and canister 22, respectively.

The location of check valve 30 between the pump outlet and the high pressure hose 58 places the high pressure hose in the segment of the fuel system 10 which is isolated by the check valve 30 following engine shut down. By placing the hose 58 between the fuel delivery system 16 and the check valve 30, it is operably as a volume accumulator for the trapped volume of fuel. This trapped fuel volume may be subject to temperature loads from such factors as engine heat rise and climatic changes. The convolute design of the high pressure hose 58 is well suited to accept the volumetric increases in the fuel as a result of such temperature and pressure increases, and the concomitant stress imposed on the fuel system can be managed in an efficient manner.

Figure 4:
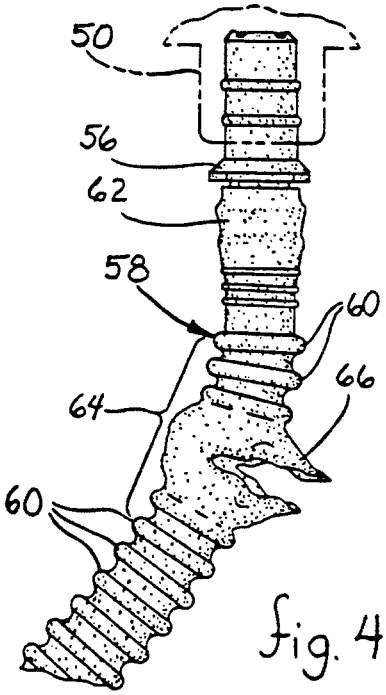
FIG. 4 is a partial view of the hose of FIG. 3 in an alternate mode.

Referring again to FIG. 3, high pressure hose 58 further includes a region of reduced wall thickness 64 which, is effective in providing a pressure fuse or point of fuel line failure in those instances in which positive pressure variations in the trapped fuel volume between the check valve 30 and the fuel delivery apparatus 16 exceed the capability of the convoluted, high pressure tube itself to act as a volume accumulator. In such instances, as illustrated in FIG. 4, the region of reduced wall thickness 64 is subject to a predetermined amount of plastic deformation during which the material in the region is strain hardened as it is thinned by the deformation process. Upon reaching a wall thickness and hardness limit which is material sensitive, the material is ruptured, as at 66, by any further increase in internal pressure. Close control of the wall thickness in region 64 facilitates precise control of the burst pressure of the hose 58 such that it is engineered to be the weak link in the fuel system, rather than another system component. The location of the hose 58 with its integral pressure fuse 64 within the fuel reservoir 20 assures that fuel leakage caused by fuel line pressurization is location controlled, within the fuel tank 20, where such a failure presents minimal inconvenience.

The fuel system of the present invention discloses a high pressure tube for use between a fuel pump check valve and the fuel delivery system at the engine. The tube is of a convoluted, flexible design which is well suited for accumulating increases in volume of fuel trapped between the check valve and the engine caused by the temperature loading of the static fuel following engine-fuel system shut-down.

In cases in which volumetric and, consequently, pressure increases are beyond the capability of the flexible tube to accommodate, a region of reduced wall thickness is provided in the high pressure hose which acts as a pressure fuse for the system. By engineering the fuse to be the weak link in the fuel system, leakage caused by over pressurization in the trapped volume segment of the fuel system can be location controlled.

The present disclosure provides a fuel system pressure fuse having a location controlled point of failure within the fuel tank or reservoir where leakage presents a minimum of inconvenience.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiments may be modified in light of the above teachings. The embodiments described were chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. A fuel system for an internal combustion engine comprising a fuel reservoir having a pump assembly disposed therein, fuel delivery means in operable communication with said engine and a fuel conduit extending between said fuel reservoir and said fuel delivery means, said fuel reservoir further comprising a port in a wall of said reservoir and a fluid connection operable with said port to connect said fuel conduit to said fuel reservoir and said pump assembly, said pump assembly having an electric pump with an inlet and an outlet with a check valve means in operable communication with said outlet and in flow communication with said fluid connection in said cover by an elastomeric hose, said hose comprising a flexible body having a plurality of sinusoidal convolutions and a region of reduced wall thickness, said elastomeric hose operable to accommodate positive pressure variation between said check valve and said fuel delivery means through expansion at said convolutions and rupture of said region of reduced wall thickness, wherein said rupture is confined to said fuel reservoir.

2. A fuel system for an internal combustion engine comprising a fuel reservoir having a pump assembly disposed therein, fuel delivery means in operable communication with said engine and a fuel conduit extending between said fuel reservoir and said fuel delivery means, said fuel reservoir further comprising an electric fuel pump having an inlet and an outlet, check valve means disposed in operable communication with said outlet, and an elastomeric hose extending between said check valve means and said fuel conduit, said hose comprising a flexible body and a region of reduced wall thickness operable to accommodate positive pressure variation in said fuel system through expansion of said flexible body and rupture of said region of reduced wall thickness.

3. A fuel system for an internal combustion engine, as defined in claim 2, further comprising a fluid connector disposed in a wall of said fuel reservoir operable to fluidly connect said elastomeric hose with said fuel conduit wherein said elastomeric hose is disposed within said fuel reservoir and rupture of said region of reduced wall thickness is confined to said fuel reservoir.

4. A fuel system pressure fuse for disposition in a fuel delivery system, comprising an elastomeric hose having a flexible body with a plurality of sinusoidal convolutions and a region of reduced wall thickness, said fuse operable to accommodate positive pressure variation in said fuel delivery system through expansion at said convolutions and rupture of said region of reduced wall thickness.

* * * * *